US005871385A

United States Patent [19]

Hippely et al.

[11] Patent Number: 5,871,385

[45] Date of Patent: Feb. 16, 1999

[54] THERMOCHROMIC TOY VEHICLE PLAYSET HAVING ROBOT ARM DETAILER

[75] Inventors: Keith A. Hippely, Manhattan Beach; Larry R. Wood, Redondo Beach; Brian E. Walsh, Mission Hills; Terence A. Choy, Lawndale, all of Calif.

[73] Assignee: Mattel, Inc., El Segundo, Calif.

[21] Appl. No.: 387,047

[22] Filed: Feb. 10, 1995

[51] Int. Cl.[6] ..... A63H 33/00; A63H 33/30; A63H 18/00

[52] U.S. Cl. ..... 446/424; 444/14; 444/444

[58] Field of Search ..... 446/14, 73, 74, 446/217, 89, 424, 425, 426, 429, 444

[56] References Cited

U.S. PATENT DOCUMENTS

| | | | |
|---|---|---|---|
| D. 204,770 | 5/1966 | Pfister . | |
| 3,997,061 | 12/1976 | Sano . | |
| 4,051,624 | 10/1977 | Ogawa . | |
| 4,254,576 | 3/1981 | Matsumoto et al. . | |
| 4,312,149 | 1/1982 | Iwao . | |
| 4,360,988 | 11/1982 | Schoenfield et al. | 446/424 |
| 4,507,043 | 3/1985 | Flatau . | |
| 4,609,363 | 9/1986 | Udagawa . | |
| 4,928,955 | 5/1990 | Chuan . | |
| 4,961,714 | 10/1990 | Hippely et al. . | |
| 4,961,716 | 10/1990 | Hippely et al. | 446/426 X |
| 5,376,772 | 12/1994 | Nakagawa et al. | 446/14 X |

FOREIGN PATENT DOCUMENTS

| | | | |
|---|---|---|---|
| 24201 | 11/1962 | Germany | 446/424 |
| 404329993 | 11/1992 | Japan | 446/14 |
| 406039151 | 2/1994 | Japan | 446/14 |
| 2092463 | 8/1982 | United Kingdom | 446/423 |

*Primary Examiner*—Robert A. Hafer
*Assistant Examiner*—D. Neal Muir
*Attorney, Agent, or Firm*—Roy A. Ekstrand

[57] ABSTRACT

A toy vehicle playset includes a trackway having a vehicle launcher coupled to a looped track portion and a dual tank unit positioned within the travel path of the toy vehicle through the trackway. The trackway further includes an exit ramp on the opposite side of the dual tank unit from the track loop which is coupled to a toy vehicle catcher and a display area. The dual tank unit includes a pair of tank portions separated by an intervening wall. The dual tank unit is supported within the trackway travel path such that either tank portion is alternatively positionable within the travel path of the toy vehicle. The playset further includes a multiply articulated robot arm supporting one or more thermally conductive tools or stamps which are immersible within the proximate one of the dual water tanks and appliable to the surface of the toy vehicle when resting in the toy vehicle catcher. The toy vehicle when launched down the trackway traverses the track loop and passes through the aligned one of the tank portions of the dual tank unit to receive a hot or cold water bath. The toy vehicle is at least partially covered with a thermochromic paint or coating and undergoes a thermochromic appearance change in the bath. Ideally, each of the tank portions is filled with a different temperature water supply.

10 Claims, 2 Drawing Sheets

THERMOCHROMIC TOY VEHICLE PLAYSET HAVING ROBOT ARM DETAILER

CROSS-REFERENCE TO RELATED APPLICATIONS

This application discloses apparatus described and claimed in copending application Ser. No. 8/387,049 (Attorney Docket 13600(3)) filed Feb. 10, 1995 on behalf of Hippely, et al. and entitled TOY VEHICLE PLAYSET HAVING VEHICLE RECEIVING AND HOLDING STATION and copending application Ser. No. 08/388,224 (Attorney Docket 13600(1)) filed Feb. 9, 1995 on behalf of Hippley, et al. and entitled TOY VEHICLE PLAYSET FOR THERMOCHROMIC VEHICLES which are assigned to the assignee of the present application.

FIELD OF THE INVENTION

This invention relates generally to toy vehicle playsets and particularly to those using thermochromic or color change toy vehicles.

BACKGROUND OF THE INVENTION

Toy vehicle playsets have proven to ben an extremely enduring and popular category of toys for a great many years. Not surprisingly, this long lasting and extensive popularity has given rise to a virtually endless variety of toy vehicle playsets. Thus, such playsets have been provided which use simple track structures and equally simple hand-rolled toy vehicles as well as more complex track structures utilizing toy vehicles which are powered or launched through the track playset. For example, a variety of toy vehicle playsets utilize a track having an elevated launching portion employing gravity and its effect upon the toy vehicle to provide a launching energy to traverse the track set. Other toy vehicle playsets have used spring-loaded or spring-powered launchers to provide the initial energy required to drive the toy vehicle through the track set. Still other toy vehicle playsets have utilized vehicles which themselves are powered using devices such as inertial drive motors, spring-driven wind-up motors, or electrical motors having battery or other electrical power sources. The variation has included a substantial divergence of the track structures themselves. The simpler track structures utilize a simple oval racetrack while others employ more complex apparatus such as inverting loop segments or jump and landing ramp segments which hurtle the toy vehicles through the air across an intervening gap.

Just as the track playsets have been subject to variation, the toy vehicles themselves have been similarly varied and diverse. Such toy vehicles are often realistic, bright colored and finely detailed. Others are less detailed, more fanciful and cartoon-like in character. Still other toy vehicles used in such playsets are configurable in alternative element arrangements to vary their appearance. One of the more interesting toy vehicle variations produced through the years employs so-called thermochromic material which forms paint or coating upon the toy vehicles and which provides a change in color in response to temperature changes. Such toy vehicles often referred to "color-change" toy vehicles have provided an interesting and amusing variation for toy designers to utilize in their endless task of providing amusing and entertaining as well as novel toy playsets.

Thus, practitioners continue to respond to the popularity of such toy vehicle playsets to improve the amusement, entertainment and novelty thereof.

For example, U.S. Pat. No. 4,961,716 issued to Hippely, et al. sets forth a TOY APPARATUS INCLUDING ROBOTIC ARM in which a robotic arm for handling toy vehicles advanced along a path past a plurality of stations including a pickup station, an immersion station and an exit station is provided. The robotic arm module has gripper members actuatable for picking up the toy vehicle at the pickup station then dipping the toy vehicle into a liquid and thereafter depositing the toy vehicle at an exit station.

U.S. Pat. No. 4,507,403 issued to Flatau sets forth a COUNTERBALANCE ROBOT ARM having a main arm formed of two parallel sections, the ends of which are pivotally connected to the forearm and drive arm to maintain a parallel relationship therebetween. A medial portion of one main arm section is pivotally mounted on a turnable pedestal. A drive motor and drive system mounted on the drive arm are connected to the other main section for moving the drive arm relative to the main arm.

U.S. Pat. No. 4,609,363 issued to Udagawa sets forth a TRACK TOY having a spiral track member mounted with respect to a larger toy robot. Gears mounted on the larger toy robot are driven by a battery powered motor within the robot. Several smaller robots placed in the lower end of the track are periodically conveyed to the upper end of the track using the gears.

U.S. Pat. No. 3,997,061 issued to Sano sets forth a TOY CRANE having a base supporting an upwardly extending tower and a boom mounted on the top portion of the tower in a rotatable attachment. A carriage mounted on the boom is movable to raise and lower a grappling member.

U.S. Pat. Des. 204,770 issued to Pfister sets forth a TOY CRANE having a generally cylindrical base member supporting a horizontally extending telescopic boom having a cable extending downwardly therefrom supporting a crane hook.

U.S. Pat. No. 4,051,624 issued to Ogawa sets forth a CONTROL TOWER AND TRACK TOY ASSEMBLY having individual track segments coupled to a three-part control tower. The control tower base incorporates a power transmission assembly capable of deriving power from a vehicle when it is restrained on the base member. An endless conveyor belt may be driven by the power transmission assembly in either a vertical or horizontal mode of operation.

U.S. Pat. No. 4,254,576 issued to Matsumoto, et al. sets forth a SPIN TOWER STATION FOR USE WITH TOY VEHICLE AND TRACKWAY having a track network connecting a plurality of stations each having its own amusement function. The spin tower receives a vehicle at a station entry port and simultaneously moves it translationally and rotationally to a station exit port positioned below.

U.S. Pat. No. 4,312,149 issued to Iwao sets forth a TRANSFER MECHANISM UTILIZING A PIVOTABLE HOLDING MEMBER having a toy trackway supporting a plurality of track segments and having a movable crane member replicating a giraffe which receives and moves various toy elements.

U.S. Pat. No. 4,928,955 issued to Chuan sets forth a TOY HAVING SLIDING RAIL having a tower member supporting a curved sliding rail. A center tower is coupled to a gear train and drive shaft within the tower base and includes a rotatable boom supporting a toy helicopter which rotates about the tower under the gear drive train movement.

While the foregoing described prior art devices have provided improvement in the art and in some instances enjoyed commerical success, there remains nonetheless a continuing need in the art for evermore improved interesting and amusing toy vehicle playset accessories and products.

SUMMARY OF THE INVENTION

Accordingly it is a general object of the present invention to provide an improved toy vehicle playset accessory. It is a more particular object of the present invention to provide an improved toy vehicle playset accessory for use with a thermochromic material coated toy vehicle which employs a robot arm for use in detailing the toy vehicle.

In accordance with the present invention, there is provided a toy vehicle playset comprising: a dual tank unit supporting a hot liquid and a cold liquid; a trackway for guiding a thermochromic toy vehicle through one of the liquids; a base supporting the dual tank unit; a thermochromic toy vehicle receiving station for receiving and holding a thermochromic toy vehicle following its having been guided through the one of the liquids; and a robot arm coupled to the base having means or supporting a thermally conductive tool and for moving the tool between the other one of the liquids and the receiving station.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
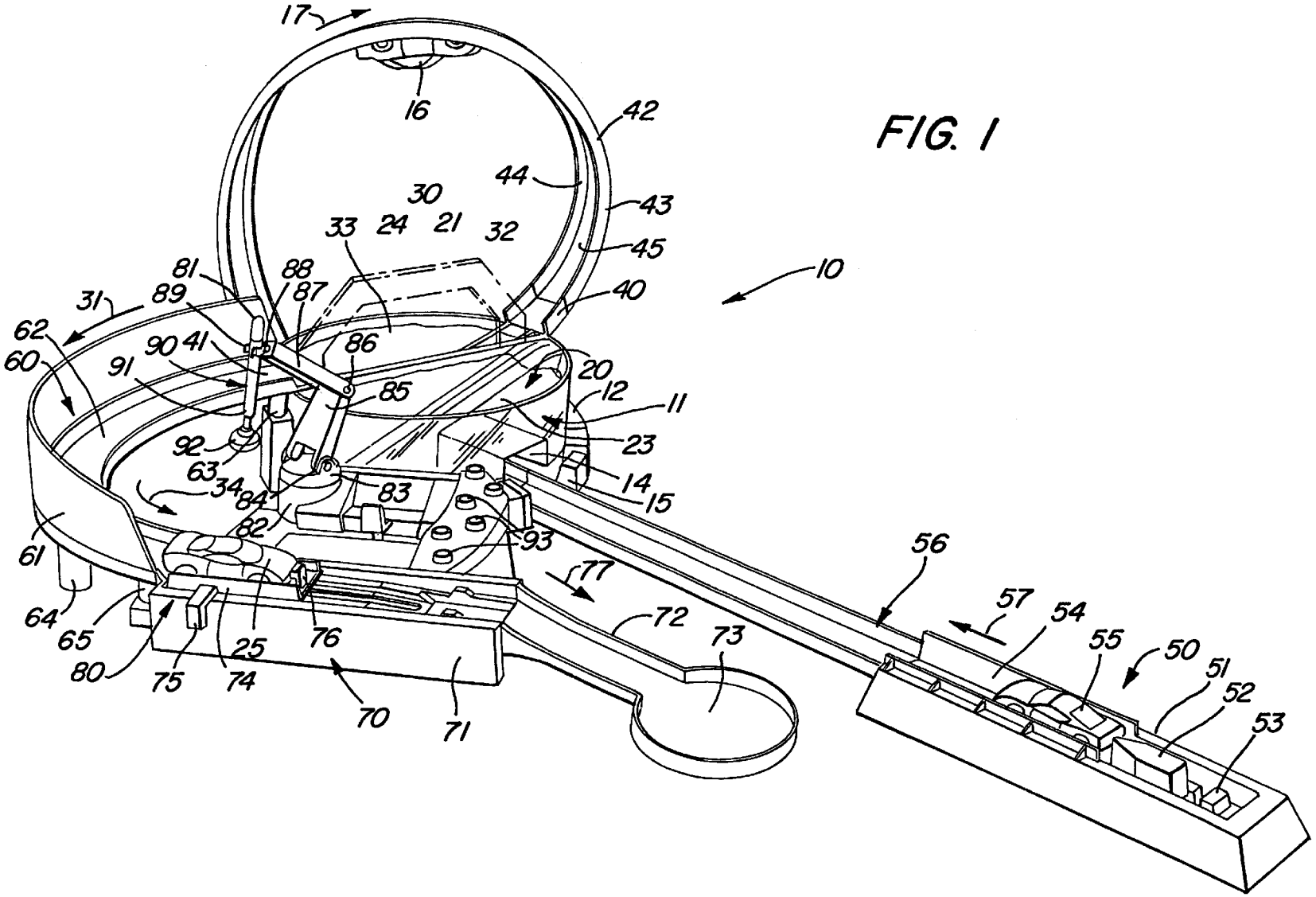
FIG. 1 sets forth a perspective view of a toy vehicle playset constructed in accordance with the present invention.

FIG. 1 sets forth a perspective view of a toy vehicle playset constructed in accordance with the present invention and generally referenced by numeral 10. Playset 10 includes a dual tank unit 11 supported by a base 12 and having a pair of tank portions 20 and 30 separated by a wall 21. Base 12 further defines an opening 15 which is coupled to and receives a straight track segment 56. A vehicle launcher 50 constructed in accordance with conventional fabrication techniques is coupled to track segment 56 and includes a housing 51 supporting a movable spring-loaded pusher 52 and a trigger latch 53. Vehicle launcher 50 further includes a staging area 54 which is shown receiving a vehicle 55 in the to-be-launched position.

Base 12 further supports an entrance gate 40 and an exit gate 41 in alignment on a common side of wall 21 of dual tank unit 11. A track loop 42 having a pair of sidewalls 43 and 44 on each side of a trackway 45 is coupled at one end to entrance gate 40 and forms a vertical loop extending downwardly into alignment with track segment 56 on the opposite side of opening 15 in base 12. Tank 20 defines a dipped ramp 22 alongside one side of wall 21 while tank 30 defines a similar dipped ramp 32 on the opposite side of wall 21. Tanks 20 and 30 support quantities of water 23 and 33 respectively which in accordance with the present invention differ substantially in temperature. Dual tank unit 11 further includes an upwardly extending handle 24 and a tunnel 14 which extends beneath tanks 20 and 30 and emerges on the opposite side of the dual tank unit in alignment with the remaining end of track loop 42.

Playset 10 further include a curved ramp 60 having a raised outer sidewall 61 and a trackway 62. Trackway 62 extends from exit gate 41 in a downwardly curved path. Ramp 60 is supported by a plurality of supports 63, 64 and 65. Playset 10 further includes a toy vehicle catcher 70 having an elongated housing 71 which receives and supports a movable shuttle 74. Shuttle 74 includes a tab 75 extending outwardly therefrom and a vehicle stop mechanism 76 at the frontal portion thereof. Toy vehicle catcher 70 further includes a downwardly extending ramp 72 terminating in a display area 73. In the position shown in FIG. 1, shuttle 74 has received and captured a toy vehicle 25 following the toy vehicle's travel down trackway 62. This position shown in FIG. 1 provides a vehicle detail area 80 in which the toy vehicle may be further enhanced in its appearance.

Toy vehicle playset 10 further includes a robot arm 81 having a support base 82 upon which a rotatable platform 83 is secured. Platform 83 includes a pivot 84 securing a support arm 85 at the lower end thereof. An arm 87 is pivotally coupled to the upper end of arm 85 by a pivotal attachment 86. A swivel joint 88 supports a clasp 89 in a pivotal attachment at the upper end of arm 87. A stamp 90 includes an elongated handle 91 received within clasp 89 supporting a thermally conductive stamper 92 at the lower end thereof. Stamper 92 is preferably formed of a thermally conductive material and defines an embossed design producing member. Toy vehicle catcher 70 further defines a plurality of tool receptacles 93 which receive and support a plurality of alternative tools generally configured in the manner shown for stamp 90 and having elongated handles such as handle 91 which are receivable within receptacles 93 for convenient access and storage.

In operation, dual tank unit 11 is initially filled with quantities of water 23 and 33 within tanks 20 and 30 having substantial temperature differences. Thus, for example, tank 20 may be filled with hot water while tank 30 is filled with cold water. Dual tank unit 11 is positioned such that tunnel 14 is aligned with opening 15 of base 12 and track segment 56. Thereafter, a toy vehicle such as vehicle 55 is placed within launcher 50 which in turn is cocked to permit the launching of vehicle 50. In the preferred play pattern of the present invention, vehicle 55 comprises a toy vehicle having at least certain portions coated or painted with a color change or thermochromic material. In the present example, water 23 within tank 20 is hot while water 33 within tank 30 is cold. Accordingly, the preferred effect of the present invention playset is provided if vehicle 55 is subjected to a hot water bath and dried prior to placement within vehicle launcher 50. This is because the position of dual unit 11 in the present example of FIG. 1 aligns tank 30 having cold water therein with track loop 42 and ramp 60.

With vehicle 55 thus configured and positioned within vehicle launcher 50, the user then pushes trigger 53 causing vehicle 55 to be launched in the direction of arrow 57 from launcher 50 in a conventional vehicle launching operation. Vehicle 55 then travels in the direction or arrow 57 through track segment 56 and opening 15 into tunnel 14. The toy vehicle continues through tunnel 14 emerging on the opposite side of dual tank unit 11 and traveling beneath tanks 20 and 30 to enter the lower end of track loop 42. Thereafter, the kinetic energy of the toy vehicle causes it to traverse track loop 42 in the direction indicated by arrow 17. For purposes of illustration, a toy vehicle 16 is shown at the midpoint of traversing track loop 42. The toy vehicle then continues traveling downwardly upon the remaining portion of track loop 42 through entrance gate 40 and into tank 30. As the toy vehicle traverses ramp 32 through tank 30, it is subjected to the cold water within tank 30 and undergoes a temperature change. The kinetic energy of the toy vehicle carries it upwardly upon the remaining portion of ramp 32 through exit gate 41 and onto trackway 62 of ramp 60 in the direction indicated by arrow 31. In the example of FIG. 1, the toy vehicle when subjected to the cold water within tank 30 undergoes a sufficient temperature change to change the thermochromic coating material thereof and produce a color change. The change occurs almost instantaneously as the vehicle traverses the tank 30. The color change vehicle traverses trackway 62 and enters shuttle 74 of toy vehicle catcher 70. The travel of the toy vehicle is stopped in the position shown by vehicle 25 through the action of stop 76.

The color changed toy vehicle now resting within shuttle 74 has assumed the color change configuration which results from cold water immersion within tank 30. At this point, the toy vehicle may be further enhanced or detailed through the use of robot arm 83 while supported within detail area 80 as shown in FIG. 1. Robot arm 81 is pivotally movable about base 82 as platform 83 rotates. In its preferred use, robot arm 81 is pivoted to extend arm 87 above tank 20 and permit stamper 92 of stamp 90 to be immersed into the hot water within tank 20 by suitable pivoting swivel joint 88, pivot 86, and pivot 84. Stamper 92 is warmed within the hot water of tank 20 and thereafter is withdrawn from water 23 by manipulation of robot arm 81. Robot arm 81 is further manipulated to position stamper 92 of stamp 90 in proximity to vehicle 25 and thereafter bring stamper 92 against a selected area of vehicle 25. As mentioned above, vehicle 25 having traversed the cold water bath of tank 30 has assumed the thermochromic characteristic of lower temperature. The warming action of stamper 92 against the cold temperature configurated vehicle causes a localized thermochromic characteristic change on the portions of vehicle 25 contacted by stamper 92 due to its warm temperature received from the warm water of tank 20. Robot arm 81 is thereafter manipulated to move stamper 92 away from toy vehicle 25 with the result that vehicle 25 now has a thermochromically imparted image corresponding to stamper 92. This process may be repeated with robot arm 81 moving stamper 92 between the hot water of tank 20 and the cold temperature configured surface of vehicle 25. If desired, a small tissue paper of absorbent material may be used to blot the warm water from stamper 92 following its immersion within tank 20.

It should be noted that the loop, while providing a novel instant color change as the cars traverse the tanks is useful, it is not essential, nor is any track through the baths. A child could simply dip the cars by hand in one of the baths and place it in the detail area for image placement with the stamp.

Once the desired images have been formed upon vehicle 25, the user then moves vehicles 25 by sliding tab 75 toward ramp 72 across toy vehicle catcher 70. Once shuttle 74 reaches ramp 72, stop 76 is released and the toy vehicle is moved onto ramp 72 and descends downwardly into display area 73 where it remains until removed by the user.

Dual tank unit 11 is reversible in its position by simply raising dual tank unit 11 slightly while grasping handle 24 and thereafter rotating dual tank unit 11 one hundred eighty degrees and then lowering dual tank unit 11 back into the seated position upon base 12. The reversal or one hundred eighty degree rotation of dual tank unit 11 switches the relative positions of tanks 20 and 30 from that shown in FIG. 1. As a result of such rotation or tank switching, the travel path of the toy vehicle passes through the hot water of tank 20 while the cold water of tank 30 is positioned in proximity to robot arm 81. Thus, the relative positions of tanks 20 and 30 and robot arm 81 assure that robot arm 81 is always subjecting the stamp or tool which it supports to a temperature opposite from that to which the toy vehicle has been most recently exposed as it travels the trackway and comes to rest in detail area 80.

Figure 2:
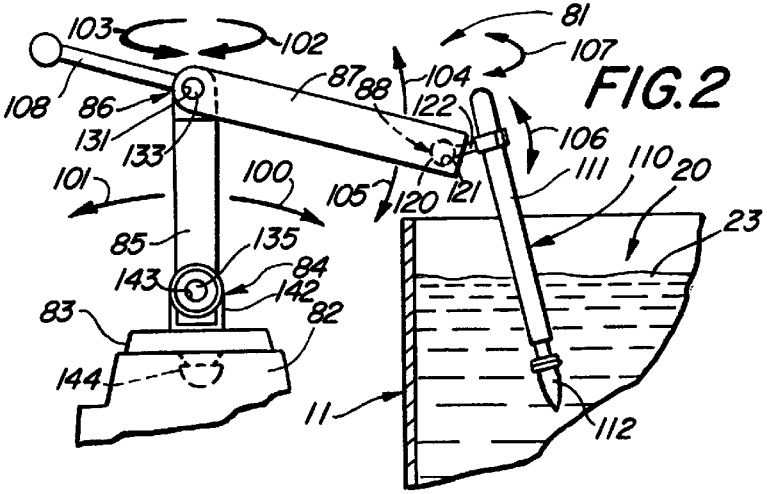
FIG. 2 sets forth a partial section view of the robot arm portion of the present invention toy vehicle playset.

FIG. 2 sets forth a partial section view of the robot arm portion of the present invention toy vehicle playset generally referenced by numeral 81. Robot arm 81 is supported upon a base 82 formed in dual tank unit 11 (seen in FIG. 1). A rotatable platform 83 includes an attachment post 144 secured to an aperture (not shown) formed within base 82. Thus, platform 83 is rotatable upon base 82 and includes a pair of upwardly extending tabs 140 and 142 (the former seen in FIG. 4). Tab 142 defines an aperture 143. Tab 140 seen in FIG. 4 defines a similar aperture 141. An elongated arm 85 includes an attachment post 135 received within aperture 143 of tab 142. Arm 85 further includes a post 132 received within an aperture 130 formed in arm 87. Arm 87 further includes a socket end 121 which receives a socket ball 120 in a swivel attachment. A post 122 extends outwardly from ball 120 and supports a tool clasp 89. A handle 108 extends from the opposite end of arm 87. As is better seen in FIG. 4, arm 85 is pivotally attached to platform attachment 83 by a pivot 84 and is secured to arm 87 in a pivotal attachment 86.

As a result of the pivotal attachments between arms 85 and 87 as well as the pivotal attachment of arm 85 to platform 83 and its rotatable attachment to base 82, robot arm 81 is movable in virtually any direction to manipulate a detail tool 110 secured within clasp 89. Further, the swivel joint attachment of clasp 89 to arm 87 formed by ball 120 and socket 121 provides further degrees of freedom of movement for detail tool 110. Detail tool 110 includes an elongated handle 111 received within clasp 89 and a thermally conductive nib 112 at its lower end. The combined results allows detail tool 110 to be moved in virtually any direction. Thus, arm 85 is pivotable about pivot 84 in the directions indicated by arrows 100 and 101. The entire structure of robot arm 81 is rotatable in the directions indicated by arrows 102 and 103. Further, arm 87 is pivotable about pivot 86 in the directions indicated by arrows 104 and 105. Finally, swivel joint 88 allows detail tool 110 to be movable in pivoting motions in virtually all planes as shown by arrows 106 and 107.

In the anticipated use of the present invention robot arm, the robot arm is manipulated to immerse nib 112 of detail tool 110 within tank 20 of dual tank unit 11. As described above, a quantity of water 23 is contained within tank 20 and preferably defines a temperature substantially different from the water within tank 30 (seen in FIG. 1). As is also described above, water 23 may be either hot or cold as desired with the intent of imparting the desired temperature to nib 112. Further, the position of tank 20 which is proximate to robot arm 81 may be replaced by tank 30 in the above-described rotational motion of dual tank unit 11. In such case, it will be understood that detail tool 110 may be immersed within tank 30 in the same manner as is shown for tank 20 in FIG. 2.

It should be noted that FIG. 1 sets forth the use of a stamp 90 in combination with robot arm 81 while FIG. 2 sets forth the use of a brush-like detail tool 110. It will be apparent to those skilled in the art that a variety of different detail tools and stamps or other apparatus may be utilized in combination with the present invention robot arm and its interaction with the present invention toy vehicle playset without departing from the spirit and scope of the present invention.

Figure 3:
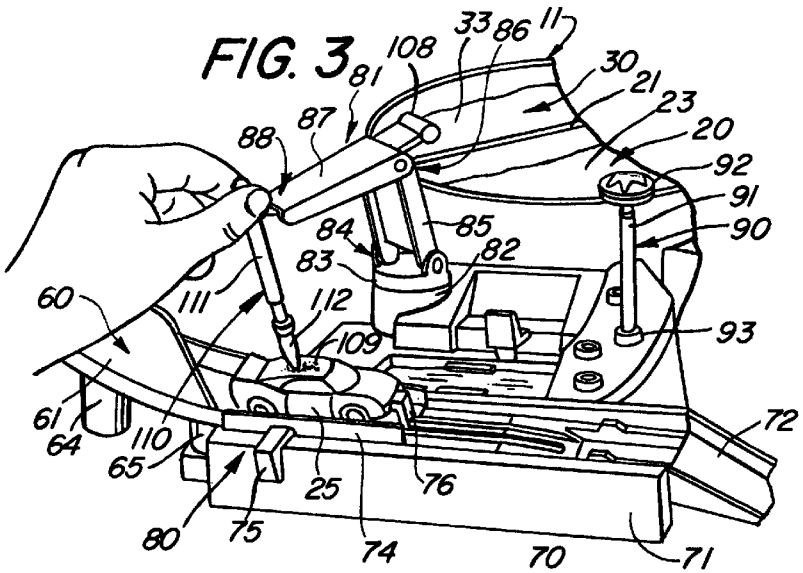
FIG. 3 sets forth a partial perspective view of the present invention robot arm detail station.

FIG. 3 sets forth a partial perspective view of the toy vehicle detailer apparatus using robot arm 81. As described above, the present invention toy vehicle playset includes a dual tank 11 having a pair of tank portions 20 and 30 separated by a wall 21 and supporting quantities of water 23 and 33 respectively which are maintained at substantially different temperature. A base 82 supports a rotatable platform 83 which in turn is coupled to an arm 85 of robot arm 81 by a pivot 84. An arm 87 is pivotally secured to the upper end of arm 85 by a pivot 86 and includes a handle 108 extending in one direction and a swivel joint 88 at the remaining end. As is better seen in FIG. 2, swivel joint 88 supports a clasp 89 which receives handle 111 of a detail tool 110. Detail tool 110 includes a thermally conductive nib 112 at its lower end. A toy vehicle catcher 70 support a movable shuttle 74 having a toy vehicle 25 retained therein by a stop mechanism 76. A tab 75 extends from shuttle 74. The position of toy vehicle 25 shown in FIG. 3 positions toy vehicle 25 at the correct operating position for detailing by robot arm 81 and tool 110. Thus, the end portion of toy vehicle catcher 70 defines a detail area generally referenced by numeral 80. A ramp 60 having a sidewall 61 supported by supports 64 and 65 is coupled to toy vehicle catcher 70 at one end and a downwardly extending ramp 72 is formed at the remaining end. A stamper 90 having a handle 91 and a stamp 92 is received within a receptacle 93 which provides convenient storage and availability of additional stamps and detail tools. It should be noted that a plurality of recesses 93 are provided for receiving and holding a plurality of stamps and detail tools when not in use.

In operation, toy vehicle 25 having completed the above-described transit through tank 30 and having therein been subjected to sufficient temperature change to provide a thermochromically caused color on its outer surface is guided to detail area 80 by ramp 60 in the above-described manner set forth in FIG. 1. Thereafter, the user pivots robot arm 81 bearing a detail tool such as tool 110 to immerse nib 112 within the opposite temperature water 23 of tank 20 in the manner shown in FIG. 2. Once sufficient thermal energy exchange has taken place to cause the temperature of nib 112 to be significantly different from the water temperature within tank 30 to which toy vehicle 25 has recently responded, the user then pivots robot arm 81 and manipulates it in the manner shown in FIG. 3. As the user brings the opposite temperature nib into contact with the vehicle surface, a localized thermochromic reaction takes place producing an image 109 upon toy vehicle 25. In accordance with an important aspect of the present invention, the relative positions of robot arm 81 and dual tank unit 11 as well as the toy vehicle track set travel path through tank 30 assure that the temperature of water used to condition nib 112 is the opposite to that most recently applied to the toy vehicle. Thus, for example in the event tank 30 holds cold water and tank 20 hot water, toy vehicle 25 is configured in the thermochromic characteristic corresponding to cold water as it reaches detail area 80. Conversely, nib 112 is immersed within the hot water of tank 20 due to its position with respect to tanks 20 and 30. This assures that nib 112 is at the opposite temperature characteristic from the water most recently applied to the toy vehicle. In the event tanks 20 and 30 are reversed by the above-described rotation, the opposite relationship nonetheless is maintained in that the toy vehicle in traveling through the playset and arriving at detail area 80 is immersed within the hot water of tank 20 while nib 112 is immersed within the cold water within tank 30.

Thus, in accordance with an important aspect of the present invention, the detail tool is automatically assured of exposure to the opposite temperature and the image such as image 109 is readily formed upon the toy vehicle. It will be apparent to those skilled in the art that a variety of detailing tools and stamps having the essential conductivity may be utilized in various shapes and sizes for stamping and detailing images upon toy vehicles 25.

Figure 4:
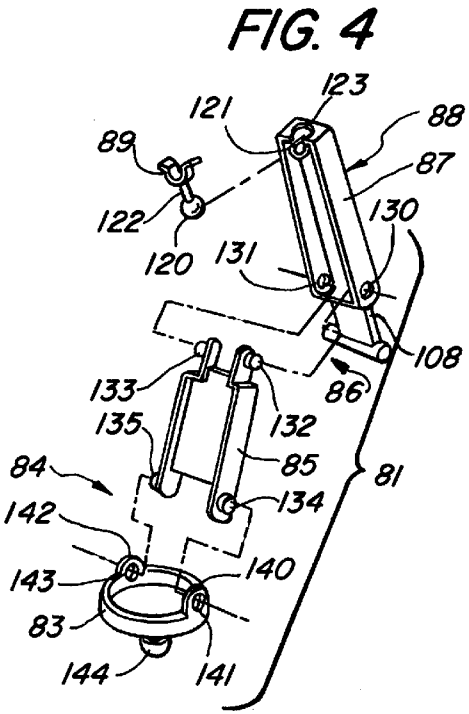
FIG. 4 sets forth a perspective assembly view of the robot arm portion of the present invention.

FIG 4 sets forth a perspective assembly view of robot arm 81. As described above, robot arm 81 includes a disk-like platform 83 having an attachment post 144 extending from the lower side thereof and a pair of upwardly extending tabs 140 and 142. Aperture 141 and 143 are formed respectively within tabs 140 and 142. An arm 85 includes a pair of outwardly extending posts 134 and 135 received within aperture 141 and 143 to form pivotal attachment 84. Arm 85 further includes a pair of outwardly extending posts 132 and 133. Robot arm 81 includes an arm 87 having a handle 108 and a socket 121 at the remaining end. A pair of apertures 130 and 131 are formed at an intermediate point of arm 87 and receive posts 132 and 133 to form pivotal attachment 86. A clasp 89 is coupled to a ball joint member 120 by a rod 122. Ball 120 is received and captivated within socket 121 such that rod 122 extends outwardly through aperture 123 of arm 87.

Figure 5:
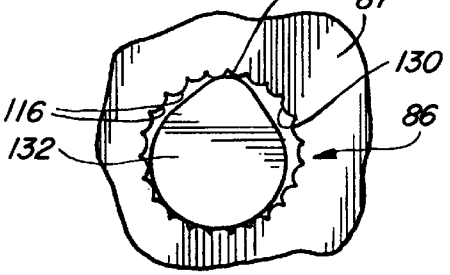
FIG 5 sets forth a partial section view of the detent mechanism operative within the present invention robot arm.

FIG. 5 sets forth a partial view of pivot 86. Arm 87 defines an aperture 130 which receives post 132 of arm 85 in the manner shown in FIG. 4. In the preferred fabrication of the present invention, post 132 is fabricated to define an eccentric portion or cam lobe 115. Correspondingly, aperture 130 is fabricated to define a plurality of inwardly extending arcuate lobes 116. The inteaction of cam lobe 115 and lobes 116 provides a plurality of detent-like positions for pivot 86. The purpose of cam lobe 115 and lobes 116 of pivot 86 is to provide a pivotal attachment which tends to maintains its position. In the preferred form of the present invention, all of the post and apertures forming pivots 84 and 86 utilize the structure shown in FIG. 5. Thus, posts 132 through 135 of arm 85 (seen in FIG. 4) are preferably all formed in the manner shown in FIG. 5 for post 132. Correspondingly, apertures 130 and 131 of arm 87 and apertures 141 and 143 of platform 83 all seen in FIG. 4 are preferably formed in the multilobed manner shown for aperture 130 in FIG. 5. As a result, each pivotal attachment within robot arm 81 provides a posable or resistive pivotal attachment which tends to maintain the last position established. The elasticity or resilience of material used to form the components of robot arm 81 facilitate the manipulation of the robot arm despite the detented joints further adding to the posable characteristic of the robot arm. Finally, ball 120 is preferably sized to fit within socket 121 in a snap-fit attachment which is slightly interfering and thus provides a resistance to movement of clasp 89 sufficient to support the weight of a detail tool.

What has been shown is a thermochromic toy vehicle playset having a robot arm detailer which cooperates and interacts with the playset to automatically expose the detailing tool to the appropriate temperature bath with respect to the thermochromic set acquired by the toy vehicle as it traverse the toy vehicle playset trackway. The entire assembly is readily fabricated of simple molded plastic parts and is low in cost manufacture. The robot is further subject to ease of manipulation by child users and facilitates a wide degree of movement, range and direction. In addition, the robot arm readily supports a selected one of a plurality of detail tools in a simple snap clasp attachment. In the preferred form the invention, each pivotal joint within the robot arm provides a motion resistive characteristic which tends to maintain the robot arm position and renders its manipulation even easier.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That is claimed is:

1. A toy vehicle playset comprising:

a trackway having an entrance gate and an exit gate for guiding a thermochromic toy vehicle;

a dual tank unit supporting a hot liquid reservoir and a cold liquid reservoir and defining first and second ramps through said hot liquid reservoir and said cold liquid reservoir respectively;

a base supporting said dual tank unit so as to align a selected one of said ramps to extend between said entrance gate and said exit gate;

a thermochromic toy vehicle receiving station for receiving and holding a thermochromic toy vehicle following its having been guided through one of said liquids via the aligned one of said ramps; and a robot arm coupled to said base having means for supporting a thermally conductive tool and for moving said tool between the liquid reservoir having the non-aligned one of said ramps and said receiving station.

2. A toy vehicle playset as set forth in claim 1 wherein said robot arm includes:

a platform rotatably supported upon said base;

a first arm pivotally coupled to said platform; and a second arm pivotally coupled to said first arm.

3. A toy vehicle playset as set forth in claim 2 wherein said means for supporting a thermally conductive tool includes a releasible clasp coupled to said second arm.

4. A toy vehicle playset as set forth in claim 3 wherein said dual tank unit is rotatable to interchange the relative positions of said liquids.

5. A toy vehicle playset comprising:

a dual tank unit supporting first and second liquid filled tanks having respective first and second ramps therethrough;

a track set having a toy vehicle travel path for guiding a toy vehicle through said first tank via said first ramp;

a toy vehicle receiving station for receiving a toy vehicle after it traverses said first ramp; and a robot arm supported between said second tank and said toy vehicle receiving station having a thermally conductive tool secured thereto, said robot arm being movable to immerse a portion of said tool into said second tank and move it to said toy vehicle receiving station to touch a toy vehicle thereon.

6. A toy vehicle playset as set forth in claim 5 wherein said robot arm further includes attachment means for releasibly grasping a thermally conductive tool.

7. A toy vehicle as set forth in claim 6 wherein said dual tank unit includes means for interchanging said first and second tanks whereby said toy vehicle travel path guides a toy vehicle through said second tank and said robot arm is movable between said first tank and said toy vehicle receiving station.

8. A toy vehicle playset comprising:

a dual tank unit having first and second liquid tanks and first and second toy vehicle trackways therethrough;

a first track segment for guiding a toy vehicle to enter said first tank and traverse said first toy vehicle trackway;

a second track segment for guiding a toy vehicle emerging from said first tank and having a vehicle receiving portion; and a robot arm supporting a thermally conductive tool and for moving said thermally conductive tool between a first position partially immersed in said second tank and a second position overlying said vehicle receiving portion.

9. A toy vehicle playset as set forth in claim 8 wherein said dual tank unit is rotatable with respect to said robot arm to interchange the relative positions of said first and second liquid tanks with respect to said robot arm.

10. A toy vehicle playset as set forth in claim 8 further including a releasible tool clasp supported by said robot arm for releasibly supporting said thermally conductive tool.

* * * * *